US006368024B2

(12) United States Patent
Kittson

(10) Patent No.: US 6,368,024 B2
(45) Date of Patent: Apr. 9, 2002

(54) GEOTEXTILE FABRIC

(75) Inventor: Mark Kittson, Niagara Falls (CA)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/162,973

(22) Filed: Sep. 29, 1998

(51) Int. Cl.[7] ..... E02D 17/20
(52) U.S. Cl. ..... 405/302.7; 428/98
(58) Field of Search ..... 405/258, 21, 16, 405/258.1, 302.7, 302.4; 428/98

(56) References Cited

U.S. PATENT DOCUMENTS

| | | | | |
|---|---|---|---|---|
| 2,902,395 | A | 9/1959 | Hirschy et al. | 428/108 |
| 3,214,289 | A | 10/1965 | Lefebvre | 442/38 |
| 3,788,271 | A | 1/1974 | Carpenter et al. | 118/33 |

(List continued on next page.)

FOREIGN PATENT DOCUMENTS

| | | | | |
|---|---|---|---|---|
| CA | 993779 | 7/1976 | | 154/114 |
| EP | 0 637 658 A1 | 7/1994 | | E04F/13/04 |

OTHER PUBLICATIONS

Miyata, K., "Walls Reinforced with Fiber Reinforced Plastic Geogrids in Japan", Geosynthetics International, 1996, vol. 3, No. 1, 1–11.

Reinhart et al., Composites, vol. 1, *Engineered Materials Handbook*, 1987.

*Primary Examiner*—Thomas B. Will
*Assistant Examiner*—Tara L. Mayo
(74) *Attorney, Agent, or Firm*—Duane Morris, LLP

(57) ABSTRACT

A unidirectional geotextile fabric for use in reinforcement of earthen retaining walls, embankments, slopes and related structures. The fabric is an open grid of high modulus of elasticity strands extending in the weft direction and strands of comparatively lower modulus of elasticity material extending in the warp direction. The fabric is preferably coated with a curable resinous material of sufficient thickness to protect the glass strands from breaking as the fabric is rolled onto cores and unrolled at the job site. When laying the fabric, a roll of the fabric is placed at one end of the face of the earthen structure being constructed and simply unrolled in a direction generally parallel to the structure's face. Because the high modulus strands of the fabric are the weft strands they extend and inhibit soil movement in a direction substantially perpendicular to the face of the structure.

21 Claims, 3 Drawing Sheets

U.S. PATENT DOCUMENTS 3,993,822 A 11/1976 Knauf et al. ..... 428/213
4,048,364 A 9/1977 Harding et al. ..... 428/113
4,064,306 A 12/1977 Scotchmer ..... 442/3
4,087,577 A 5/1978 Hendrickson ..... 428/110
4,117,686 A 10/1978 Hilfiker ..... 405/284
4,203,788 A 5/1980 Clear ..... 156/44
4,242,779 A 1/1981 Curinier et al. ..... 28/101
4,273,476 A 6/1981 Kotulla et al. ..... 405/258
4,302,495 A 11/1981 Marra ..... 428/110
4,340,558 A 7/1982 Hendrickson ..... 264/151
4,361,613 A 11/1982 Bogner et al. ..... 428/119
4,378,405 A 3/1983 Pilgrim ..... 428/322.7
4,472,086 A * 9/1984 Leach ..... 405/258
4,491,617 A 1/1985 O'Connor et al. ..... 442/32
4,504,335 A 3/1985 Galer ..... 156/42
4,504,533 A 3/1985 Altenhofer et al. ..... 428/70
4,564,544 A 1/1986 Burkard et al. ..... 428/70
4,578,301 A 3/1986 Currie et al. ..... 428/109
4,610,568 A * 9/1986 Koerner ..... 405/258 X
4,616,959 A 10/1986 Hilfiker ..... 405/286
4,643,119 A 2/1987 Langston et al. ..... 112/421
4,647,496 A 3/1987 Lehnert et al. ..... 442/386
4,810,569 A 3/1989 Lehnert et al. ..... 442/386
4,837,387 A * 6/1989 Van de Pol ..... 405/258 X
4,856,939 A 8/1989 Hilfiker ..... 405/284
4,910,064 A 3/1990 Sabee ..... 428/113
4,948,647 A 8/1990 Burkard ..... 428/70
4,960,349 A * 10/1990 Willibey et al. ..... 405/258 X
4,992,003 A 2/1991 Perach ..... 405/302.7
5,079,078 A 1/1992 Jutte, Jr. et al. ..... 428/294.7
5,091,247 A 2/1992 Willibey et al. ..... 442/46
5,108,224 A 4/1992 Cabaniss et al. ..... 256/12.5
5,139,841 A 8/1992 Makoui et al. ..... 428/109
5,148,645 A 9/1992 Iehnert et al. ..... 52/443
5,161,917 A 11/1992 Papetti ..... 405/284
5,163,261 A 11/1992 O'Neill ..... 52/610
5,200,246 A 4/1993 Sabee ..... 428/109
5,267,816 A 12/1993 Mercer et al. ..... 405/302.7
5,319,900 A 6/1994 Lehnert et al. ..... 52/408
5,342,680 A 8/1994 Randall ..... 442/71
5,350,554 A 9/1994 Miller ..... 264/171.11
5,370,756 A 12/1994 Buis et al. ..... 156/71
5,371,989 A 12/1994 Lehnert et al. ..... 52/309.17
5,397,631 A 3/1995 Green et al. ..... 428/219
5,419,092 A 5/1995 Jaecklin ..... 52/562
5,552,187 A 9/1996 Green et al. ..... 427/389.8
5,709,053 A 1/1998 Kuroda ..... 52/145
5,735,640 A * 4/1998 Meyer et al. ..... 405/258
6,054,205 A 4/2000 Newman et al. ..... 428/221

* cited by examiner

GEOTEXTILE FABRIC

FIELD OF THE INVENTION

The present invention relates in general to soil reinforcement fabrics and in particular to geotextile fabrics for reinforcing earthen structures.

BACKGROUND OF THE INVENTION

Geotextile fabrics are commonly used to stabilize or reinforce earthen structures such as retaining walls, embankments, slopes and the like. Existing technologies include polyolefins (e.g., polypropylene and polyethylene) and polyesters which are formed into flexible, grid-like sheets. The sheets are stored on rolls whereby discrete lengths of the sheets are sequentially cut from the rolls and placed at the job site such that the higher strength warp strands thereof are disposed in a direction generally perpendicular to the face of the earthen structure.

Despite ease of manufacture and installation, polyolefin and polyester grids are low modulus of elasticity materials typically having Young's moduli on the order of about 10,000 to about 75,000 psi for polyolefin grids and from about 75,000 to about 200,000 psi for polyester grids. Such low modulus products display high strain when subjected to the stresses in typical earthen structures. In some cases overlying soil and other forces associated with or imposed upon the earthen structure may induce as much as twelve inches of strain in polyolefin grids directions substantially transverse to the face of the earthen structure. Strains of this magnitude may destabilize not only the soil structure itself but also nearby structures such as buildings or roadways directly or indirectly supported by the soil structure.

Polyolefin grids may also undergo considerable creep when subjected to substantially constant loadings of the nature and magnitude of those typically exerted by or upon earthen structures. Thus, even if the short term strains are innocuous, the long term creep effects of polyolefin grids may be sufficient to threaten the integrity of the reinforced earthen structure and its surroundings.

Geotextile fabrics incorporating high modulus of elasticity materials have also been proposed for reinforcement of soil structures. These fabrics typically comprise elongate grid-like sheets wherein substantially parallel strands of high modulus material such as glass fiber rovings or the like extend in the longitudinal (or "warp" or "machine") direction of the fabric and in the transverse (or "weft" or "cross-machine") direction thereof. The glass strands are connected to one another so as to form an open grid and the entire assembly may be coated with a resinous material. The resinous material imparts a measure of semi-rigidity to facilitate handling of the fabric and protects the fabric from environmental degradation. Glass fiber roving strands have far higher moduli of elasticity and creep resistance than comparably sized polyolefin or polyester strands. For instance, the modulus of elasticity of a typical glass fiber strand in a geotextile fabric may be on the order of about 1,000,000 to about 4,000,000 psi. Glass strands can thus withstand much greater stress and undergo much less strain than comparably sized polyolefin or polyester strands. As such, glass-based geotextile fabrics generally provide superior reinforcement of earthen structures in relation to polyolefin or polyester grids.

Generally, soil movement is more likely to occur in a direction perpendicular rather than parallel to the face of an earthen structure. In selecting appropriate geotextile fabric reinforcement, therefore, a primary consideration is the minimization of soil movement transverse to the earthen structure's face. It is thus essential that higher strength strands be disposed substantially perpendicular to the face of the earthen structure, whereas lower strength strands are generally suitable for disposition substantially parallel to the structure's face.

Presently available geotextile fabrics possess higher strength strands in the warp direction of the fabric. In placing existing geotextile fabrics, a desired length of fabric is cut from a roll and laid such that the high strength warp strands extend perpendicular to the face of the earthen structure being constructed. Thereafter, another length of fabric is cut from the roll and placed adjacent to the first length of fabric with its high strength warp strands also extending perpendicular to the face of the earthen structure. The process of sequential cutting and placing of sections of fabric is repeated as necessary to substantially span the length of the face of the earthen structure. While the current practice of incremental placement of fabric sections produces acceptable end results, the process is unduly labor-intensive and time-consuming.

An advantage exists, therefore, for a unidirectional geotextile fabric which may be rapidly installed with minimal effort.

SUMMARY OF THE INVENTION

The present invention provides a unidirectional geotextile fabric for use in reinforcement of earthen retaining walls, embankments, slopes and related structures. The fabric comprises high modulus of elasticity strands extending in the weft direction of the fabric and comparatively lower modulus of elasticity yarn, thread or similar stitching material extending in the warp direction. The high modulus weft strands preferably comprise monofilament or bundled glass fibers which are connected to one another with heavy polyester warp yarn so as to establish an open grid fabric. The fabric is coated with a curable resinous material of sufficient thickness to protect the glass strands from damage as the fabric is rolled onto cores and unrolled at the job site. The resinous coating renders the fabric semi-rigid to thereby facilitate handling of the fabric and is of a composition suitable to resist moisture, abrasion and chemical degradation when the fabric is installed in an earthen structure.

When laying the fabric, a roll of the fabric is placed at one end of the face of the earthen structure being constructed and simply unrolled in a direction generally parallel to the structure's face. Because the high modulus strands of the fabric are the weft strands they extend substantially perpendicular to the face of the structure. Hence, there is no need to cut and maneuver individual sections of the fabric to achieve desirable strand orientation, and installation time and effort are correspondingly reduced. Additionally, since the weft strands establish the width of the fabric, the fabric rolls may be easily manufactured or precut to any desired width to satisfy virtually any installation requirements.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
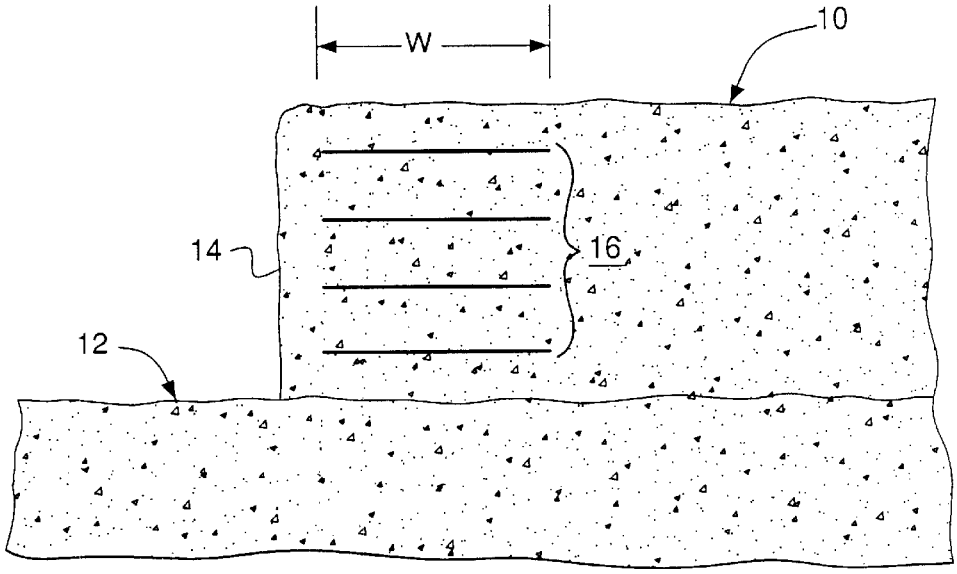
FIG. 1 is an elevational cross-section view of an earthen structure reinforced with geotextile fabric.

Referring to FIG. 1, there is shown an earthen structure 10 resting atop a suitable natural or artificial foundation 12. The face 14 of structure 10 may form an angle of between about 60° to, as illustrated, about 90° with respect to foundation 10. Structure 10 may be any height and may include one or more strata of substantially horizontally disposed reinforcement 16. Reinforcement 16 normally has a width W of several feet and spans substantially the entire length of the face 14 of structure 10. A typical ten foot high earthen retaining wall structure, for example, may include about two to about four strata of five to six feet wide reinforcement 16 spaced inwardly from the structure face 14 by a few inches to a few feet.

Figure 2:
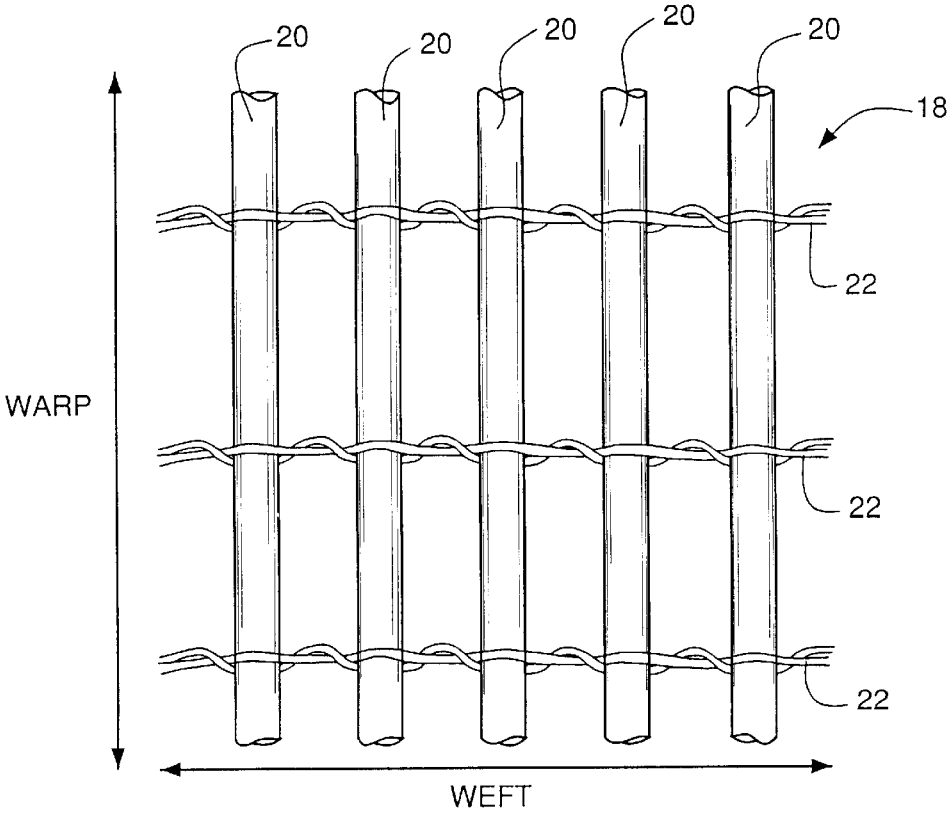
FIG. 2 (PRIOR ART)
FIG. 2 is a plan view of unidirectional geotextile fabric known in the art.

FIG. 2 shows the general construction of a conventional geotextile fabric 18 suitable for use as reinforcement in an earthen structure such as structure 10 of FIG. 1. Fabric 18 is a unidirectional fabric. As used herein, the term "unidirectional" shall be construed to mean a fabric having strands of high modulus of elasticity material extending in one or the other, but not both, of the longitudinal (i.e., "warp" or "machine") direction and the transverse (i.e., "weft" or "cross-machine") direction of the fabric. In this connection, fabric 18 is longitudinally unidirectional in that it includes a plurality of spaced-apart high modulus of elasticity warp strands 20 such as bundled glass rovings or the like which are loosely stitched together by comparatively low modulus of elasticity weft strands 22 such as polyester yarn, thread or the like.

Figure 3A:
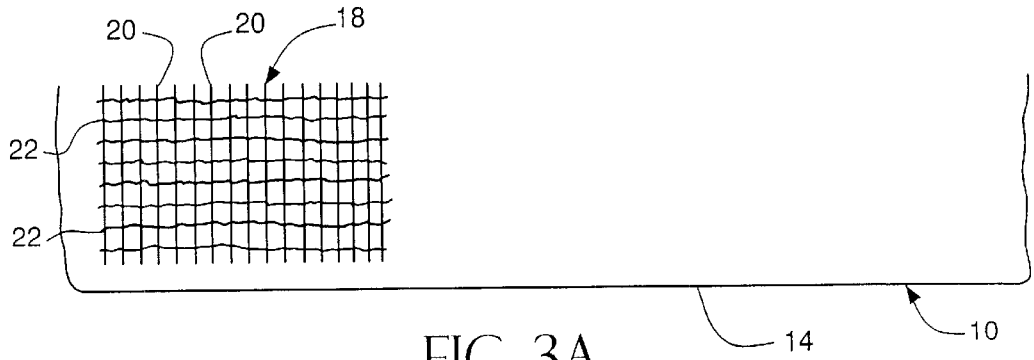
FIG. 3A (PRIOR ART)
FIGS. 3A, 3B and 3C sequentially depict installation of the geotextile fabric of FIG. 2.
Figure 3B:
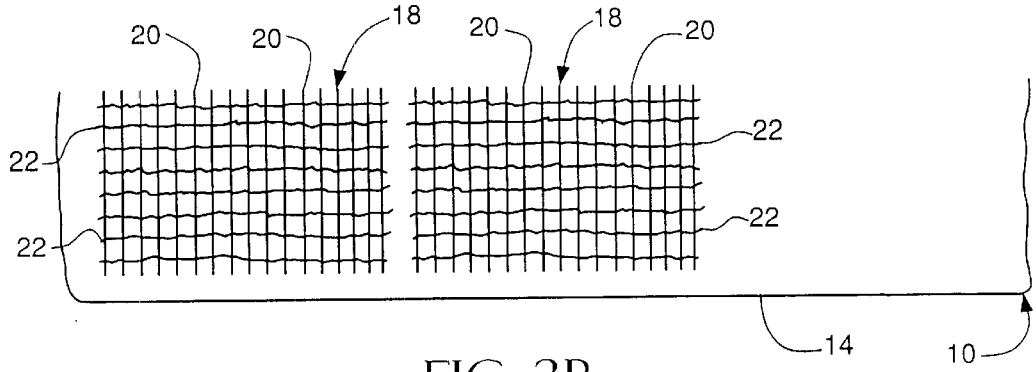
FIG. 3B (PRIOR ART)
Figure 3C:
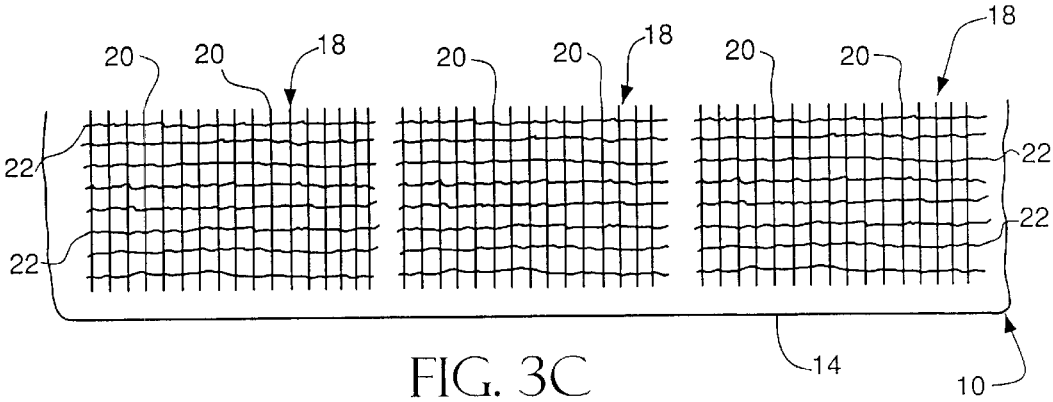
FIG. 3C (PRIOR ART)

FIGS. 3A, 3B and 3C depict the process by which fabric 18 is installed as geotextile reinforcement in an earthen structure 10. As shown in FIG. 1A, a first desired length or section of fabric 18 is cut from the end of an unillustrated fabric roll and the cut section is laid on the earthen structure 10 such that the high modulus warp strands 20 extend substantially perpendicular to the face 14 of the structure. Thereafter, as shown in FIG. 3B, another section of fabric 18 is cut from the roll and placed adjacent the first length of fabric with its high modulus warp strands 20 extending perpendicular to the face 14 of the earthen structure 10. The process of sequential cutting and placing of individual sections of fabric 18 is repeated as necessary to substantially span the length of the face 14 of the earthen structure 10 as is represented in FIG. 3C.

Figure 4:
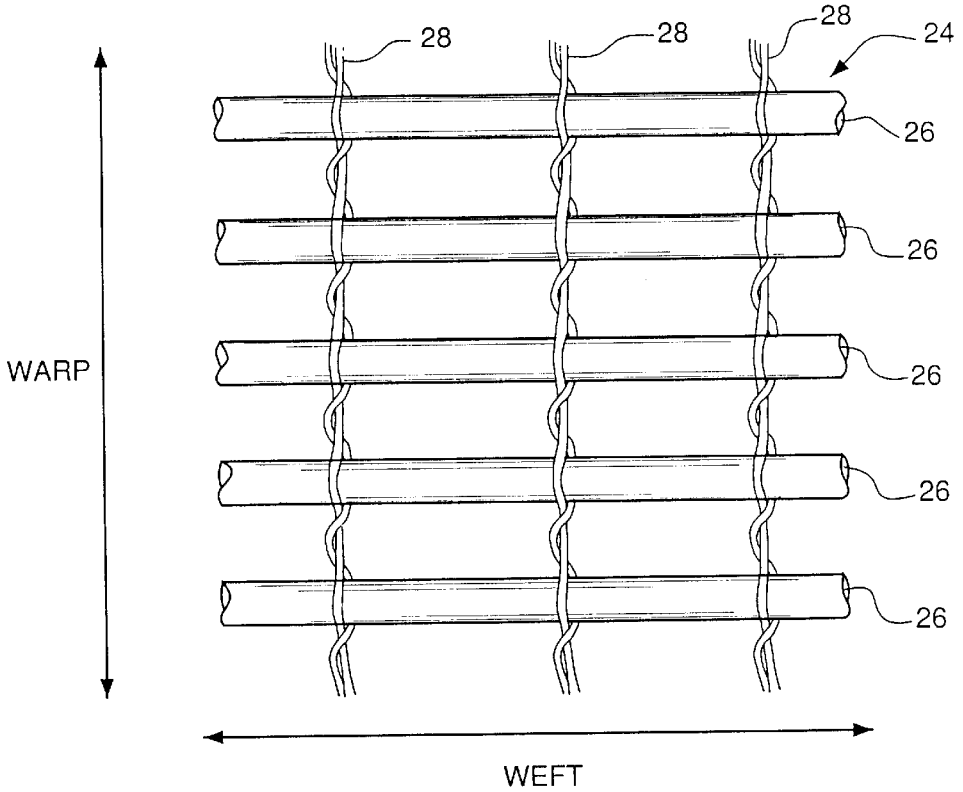
FIG. 4 is a plan view of a unidirectional geotextile fabric in accordance with present invention.

FIG. 4 illustrates a unidirectional geotextile fabric 24 according to the present invention which is suitable for use in reinforcement of earthen retaining walls, embankments, slopes and related structures. Fabric 24 is laterally unidirectional in that it includes a plurality of spaced-apart high modulus of elasticity weft strands 26 connected together with comparatively low modulus of elasticity warp strands 28. As will be described in detail hereinafter, fabric 24 has an open grid structure which is impregnated with a resinous material which coats the strands 26, 28 but does not substantially reduce the area of the open spaces between the strands.

When impregnated, the fabric grid 24 of the present invention is preferably semi-rigid and can be rolled-up on a core for each transport as a prefabricated continuous component to the place of installation, where it may readily be rolled out continuously for rapid, economical, and simple incorporation into an earthen structure. For example, it can be placed on rolls of from about one to about 20 feet wide containing a single piece up to 100 yards or more in length.

The impregnated fabric grid 24, though semi-rigid, tends to lie flat when unrolled. This believed to be due to the proper selection of resin and the use of appropriate strands in the grid. The large grid openings permit substantial contact between underlying and overlying layers of soil. This permits substantial transfer of stresses from the soil to the weft fibers 26.

The grid of this invention may be formed of weft strands 26 of continuous monofilament or bundled filament glass fibers, though other high modulus fibers such as, for example, carbon fibers, graphite fibers, or polyamide fibers which are aramids such as poly para-phenylene terephthalamid known as Kevlar® may be used. ECR or E glass rovings of 2000 tex are preferred, though one could use weights ranging from about 134 to about 5000 tex. These strands, which are preferably low twist (i.e., about one turn per inch or less), are disposed substantially parallel to one another at a spacing of about ¾" to 1", though spacing ranging from ⅛" to six inches may be used. The weft strands 26 are preferably stitched or otherwise loosely connected to one another via chain loops, tricot loops or the like, with tough yet supple thread or yarn such as 70 to 2000 denier polyester yarn or the like. The openings established by weft and warp strands 26, 28 preferably range from about ¾" to 1" on a side, though openings ranging from about ⅛" to six inches on a side may be used. Strands 26, 28 may be united using warp-knit, weft-insertion knitting apparatus or other conventional weaving equipment.

Once the grid is formed, and before it is laid in place in an earthen structure, a resin, preferably a polyvinyl chloride (PVC) plastisol resin or the like, is applied. That is to say, the grid is "pre impregnated" with resin. The resin may be a hot melt, solvent-based or water-based and is preferably applied at al level of about 100 to about 300% DPU (dry-weight pick up), i.e., about 100 to about 300 parts dry weight of resin to 100 parts by weight of fabric.

The viscosity of the resin is selected so that it penetrates into the strands of the grid. While the resin may not surround every filament in a glass fiber strand, the resin is generally uniformly spread across the interior of the strand. This impregnation makes the grid semi-rigid and cushions and protects the glass strands and filaments from corrosion by water and other elements in the soil environment. The impregnation also reduces abrasion between glass strands or filaments and the cutting of one glass strand or filament by another which is particularly important after the grid has been laid down but before the overlayment has been applied.

The grid should preferably have a minimum strength of 10 kiloNewtons per meter (kN/m) in the direction of the weft strands 26, more preferably at least 50 kN/m and up to about 100 kN/m or more.

A preferred warp knit, weft inserted fabric 24 may be prepared using 2000 tex rovings of continuous filament fiberglass in cross-machine (weft) direction. These rovings may be joined together by any conventional stitching, weaving, knitting or related process using 1000 denier continuous filament polyester thread into a structure having openings of from about ⅛" to about 6" on a side. The structure is thereafter saturated with a PVC plastisol. This thorough impregnation with resin serves to protect the glass filaments from the corrosive effects of water and to reduce friction between the filaments, which can tend to damage them and reduce the strength of the fabric. The resulting grid may weigh from about 25 to about 10,000 grams per square meter and may have a tensile strength across the width of about 10 to about 400 kN/m. The modulus of elasticity across the width (weft) may be about 500,000 to about 4,000,000 psi and the grid can be rolled and handled with relative ease.

Figure 5A:
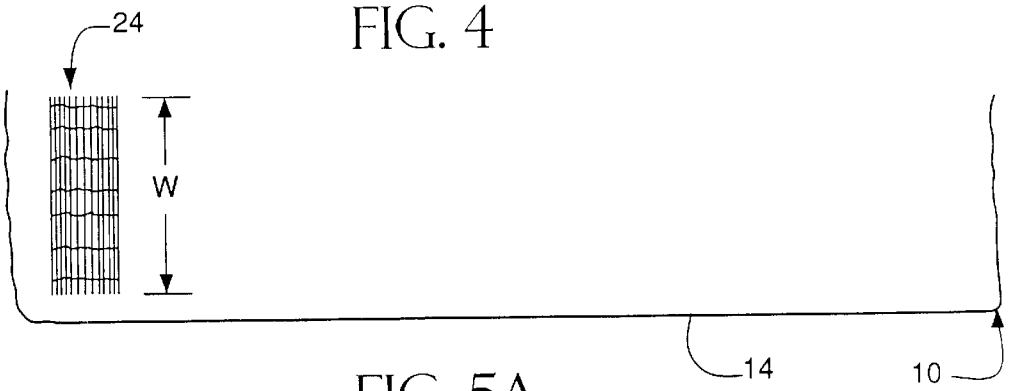
FIGS. 5A and 5B sequentially depict installation of the geotextile fabric of FIG. 4.
Figure 5B:
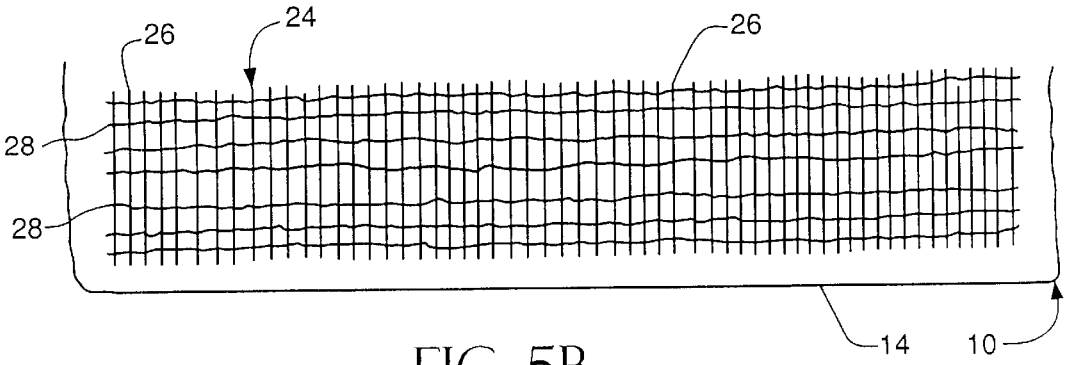

FIGS. 5A and 5B illustrate the preferred manner by which the geotextile fabric according to the present invention may be installed on an earthen structure. A roll of fabric 24 is disposed adjacent one end of structure 10 and near the face of 14 thereof as shown in FIG. 5A. Then, the roll of fabric 24 is unrolled in a direction generally parallel to the structure's face until it substantially spans the length of the structure as shown in FIG. 5B. In this way, the weft strands 26 extend substantially perpendicular to the face 14 of structure 10 simply by unrolling the fabric along the face of the structure. Unlike fabric 18 depicted in FIGS. 3A, 3B and 3C there is no need to cut and reorient individual sections of the fabric 24. As such, the time and effort required to install fabric 24 are considerably less than unidirectional geotextile fabrics heretofore known in the art.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A laterally unidirectional geotextile fabric comprising:

a plurality of spaced-apart, substantially parallel weft yarns, strands or roving comprising a material selected from the group consisting of glass fibers, carbon fibers, graphite fibers, and aramid fibers; and a plurality of spaced-apart, substantially parallel warp yarns, strands or roving connecting said weft yarns, strands or roving to establish an open grid structure, said warp yarns, strands or roving comprising a plastic textile fiber made of a substantially lower modulus of elasticity material than said material of said weft yarns, strands or roving.

2. The fabric of claim 1 wherein said open grid structure is impregnated with a resinous material.

3. The fabric of claim 2 wherein said resinous material comprises polyvinyl chloride plastisol.

4. The fabric of claim 3 wherein said polyvinyl chloride plastisol is applied to said open grid structure at a level of about 100% to about 300% dry weight pick up.

5. The fabric of claim 2, having a weight per square meter of about 25 to about 10,000 grams.

6. The fabric of claim 2, having a modulus of elasticity in the weft direction of about 500,000 to about 4,000,000 psi.

7. The fabric of claim 2, having a tensile strength in the weft direction of about 10 to about 400 kN/m.

8. The fabric of claim 2, having a tensile strength in the weft direction of at least about 100 kN/m.

9. The fabric of claim 1 wherein said weft strands comprise strands selected from the group consisting of glass fibers, carbon fibers, graphite fibers and poly)p-phenylene terephthalamide fibers.

10. The fabric of claim 1 wherein said warp strands comprise polyester yarn.

11. The fabric of claim 10 wherein said polyester yarn is about 70 to about 2000 denier.

12. The fabric of claim 1 wherein said weft yarns, strands, or roving comprise glass roving.

13. The fabric of claim 12 wherein the weight of said weft strands is from about 134 to about 5000 tex.

14. The fabric of claim 12 wherein the weight of said weft strands is from about 134 to about 5000 tex.

15. The fabric of claim 14 wherein the weight of said weft strands is about 2000 tex.

16. The fabric of claim 15 wherein said glass rovings have a twist rate of about one turn per inch or less, and wherein said glass rovings have spacing between ¾ and 1 inch, and wherein said warp strands comprise polyester yarn, said polyester yarn being about 1000 denier, and wherein said fabric is impregnated with polyvinyl chloride plastisol, and wherein said grid has a tensile strength in the weft direction of between about 50 to 100 kN/m or more, and wherein said grid weighs from about 25 to about 10,000 grams/$m^2$, and wherein said modulus of elasticity across the weft direction is about 500,000 to about 4,000,000 psi.

17. The fabric of claim 12 wherein said glass rovings are selected from the group consisting of E glass rovings and ECR glass rovings.

18. The fabric of claim 1 wherein the twist of the strands is about one turn per inch or less.

19. The fabric of claim 1 wherein the weft strands and warp strands have a spacing of between ⅛ inch and 6 inches.

20. The fabric of claim 19 wherein the weft strands have a spacing between ¾ inch and 1 inch.

21. A method of reinforcing an earthen structure comprising:

providing a roll of unilateral geotextile fabric having a plurality of substantially parallel weft strands comprising fibers selected from the group consisting of glass fibers, carbon fibers, graphite fibers, and aramid fibers, and a plurality of substantially parallel warp strands connecting said weft strands, wherein said warp strands comprise plastic textile fibers made from a lower modulus of elasticity material than a modulus of elasticity of the glass, carbon, graphite or aramid fibers of said weft strands;

placing said roll of fabric on said earthen structure such that said weft strands extend substantially perpendicular to a face of said structure; and unrolling said roll in a direction substantially parallel to said face.

* * * * *

UNITED STATES PATENT AND TRADEMARK OFFICE

CERTIFICATE OF CORRECTION

PATENT NO. : 6,368,024 B2
APPLICATION NO. : 09/162973
DATED : April 9, 2002
INVENTOR(S) : Mark Kittson It is certified that error appears in the above-identified patent and that said Letters Patent is hereby corrected as shown below:

Please delete claim 9.

Col. 6, line 7, "said warp strands comprise" should read --the plastic textile fiber is.--

Please delete claim 13.

Col. 6, line 22, "3/4 and 1 inch" should read --3/4 inch and 1 Inch.--

Col. 6, line 42, "unilateral" should read --unidirectional.--

Signed and Sealed this

Fifth Day of December, 2006

JON W. DUDAS
*Director of the United States Patent and Trademark Office*